US010836536B2

(12) United States Patent
Speck

(10) Patent No.: US 10,836,536 B2
(45) **Date of Patent: *Nov. 17, 2020**

(54) TAP ASSEMBLY FOR SOLVENT CONTAINER

(71) Applicant: PRO FORM PRODUCTS LIMITED, Milton (CA)

(72) Inventor: James H. Speck, Campbellville (CA)

(73) Assignee: Pro Form Products Ltd., Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/694,375

(22) Filed: Nov. 25, 2019

(65) Prior Publication Data

US 2020/0102121 A1 Apr. 2, 2020

Related U.S. Application Data

(63) Continuation of application No. 15/446,647, filed on Mar. 1, 2017, now Pat. No. 10,486,861.

(60) Provisional application No. 62/337,661, filed on May 17, 2016, provisional application No. 62/330,470, filed on May 2, 2016.

(51) Int. Cl.

| | |
|---|---|
| ***B65D 25/48*** | (2006.01) |
| ***B01F 13/00*** | (2006.01) |
| ***B65D 6/40*** | (2006.01) |
| ***B65D 25/32*** | (2006.01) |
| ***B65D 47/30*** | (2006.01) |

(52) U.S. Cl.

CPC ..... *B65D 25/48* (2013.01); *B01F 13/002* (2013.01); *B65D 7/40* (2013.01); *B65D 25/32* (2013.01); *B65D 47/305* (2013.01)

(58) Field of Classification Search

CPC ..... B65D 25/48; B65D 25/32; B65D 7/40; B65D 47/305; B01F 13/002

See application file for complete search history.

(56) References Cited

U.S. PATENT DOCUMENTS

| | | | | | |
|---|---|---|---|---|---|
| 197,755 | A | * | 12/1877 | Banister | A47J 43/046 241/282.1 |
| 927,952 | A | | 7/1909 | Cooke | |
| 972,727 | A | | 10/1910 | Stockmann | |
| 1,513,637 | A | * | 10/1924 | Schwartz | B21D 51/40 285/204 |
| 1,717,478 | A | | 6/1926 | Vilas Royal | |
| 2,465,463 | A | * | 3/1949 | Lindemuth | F27B 1/00 266/141 |
| 2,636,643 | A | | 4/1953 | McCauley | |
| 3,170,592 | A | * | 2/1965 | Ullman | B65D 25/32 220/776 |

(Continued)

*Primary Examiner* — David P Angwin
*Assistant Examiner* — Bob Zadeh
(74) *Attorney, Agent, or Firm* — Fay Sharpe LLP; James E. Scarbrough

(57) ABSTRACT

A tap and solvent container assembly includes a container having an upper wall, a bottom wall and a side wall connecting the upper wall and said bottom wall. A bung hole is formed in the side wall and a threaded bung assembly is mounted within the bung hole. The threaded bung assembly has a threaded member and a tap assembly is threadedly mounted to the threaded member. The container has an inner reservoir for containing liquids such as solvents, paint, thinners, reducers, etc. The top assembly is used to dispense the liquids from the container.

19 Claims, 7 Drawing Sheets

(56) References Cited

U.S. PATENT DOCUMENTS

| | | | | |
|---|---|---|---|---|
| 4,247,134 | A * | 1/1981 | Yergen | F16L 41/10 251/144 |
| 4,341,240 | A | 7/1982 | Cerrato | |
| 4,497,580 | A | 2/1985 | Doyel | |
| 4,640,493 | A | 2/1987 | Dudzik | |
| 5,489,151 | A | 2/1996 | Weber | |
| 5,549,381 | A | 8/1996 | Hays et al. | |
| 6,601,604 | B1 * | 8/2003 | Cooper | A62C 37/50 137/269 |
| 2005/0199361 | A1 | 9/2005 | Alois | |
| 2005/0199631 | A1 * | 9/2005 | Alois | B65D 39/0005 220/375 |
| 2009/0135668 | A1 | 5/2009 | Hamilton | |

* cited by examiner

TAP ASSEMBLY FOR SOLVENT CONTAINER

CLAIMS OF PRIORITY

This application is a continuation of Non-Provisional patent application Ser. No. 15/446,647 filed on Mar. 1, 2017 (assigned U.S. Pat. No. 10,486,861) which claims priority from and the benefit of Provisional Patent Application Ser. No. 62/330,470 filed on May 2, 2016 and Provisional Patent Application Ser. No. 62/337,661 filed on May 17, 2016. The entire disclosure of each of said prior applications is hereby incorporation by reference into the present specification.

BACKGROUND OF THE DISCLOSURE

This disclosure relates to a tapping system for liquid containers or the like such as, for example, solvent containers or cans. In particular, this disclosure relates to a tapping system for solvent cans or pails or the like or for the conversion of solvent cans or containers or the like to provide prompt placement of solvent cans in service, the removal thereof from service when substantially empty and the maintenance of prompt and sound delivery of the solvent during service in optimal condition. For example, the tap and solvent container can be used in the automotive, marine, industrial, agricultural and pharmaceutical industries, as well as other industries.

Specifically, the disclosure relates to the addition of a tap to a solvent can for the dispensing of solvent therefrom. A tap is a valve used for controlling the release of a liquid from a container or enclosure. Taps are often used for dispensing liquids such as seen in beer kegs (see e.g. U.S. Pat. No. 4,341,240 which is hereby incorporated by reference herein) and with boxes storing coffee or with boxes storing wine (see e.g. U.S. Pat. No. 4,640,493 which is hereby incorporated by reference herein).

Referring to FIGS. 1 and 2, with existing solvent cans A, the user often has to pull the bung cap B, by the pull tab T to pull the expandable spout S out of the can, which requires some effort. Then the user has to pull the inner seal pull tab IT (FIG. 2A) to open the container to be able to pour out the solvent or paint or other liquid. The inner seal pull tab IT is then discarded. The plastic bung cap B must be screwed back onto the spout S to prevent contamination and solvent evaporation. Alternatively, a pump may be inserted into the can to extract the solvent or paint or liquid therefrom. These methods are undesirable as they may lead to waste of some of the solvent or spilling of the solvent causing potential fire and other hazards or staining.

Accordingly, there exists a need for a solvent can which includes a tap mounted thereto to easily extract and pour solvent from the container or can without the need for pulling a cap or spout, and which overcomes the above invented difficulties and others while providing better overall results.

SUMMARY OF THE DISCLOSURE

In accordance with one embodiment of the disclosure, a solvent can is provided. The solvent can itself is made of metal or steel, such as stainless steel, as well as the lid and bottom wall. In accordance with another embodiment of the disclosure, the solvent can also be made of durable plastic, or possibly a combination of plastic and metal.

In accordance with another embodiment of the disclosure, the tap and can assembly of the disclosure can be used in at least the following applications: paint and coatings, such as clears, primers, rustproofing, truck bed coatings, etc.; solvents such as Xylene, Acetone, Toluene, mineral spirits, gun wash, etc.; reducers and thinners, such as urethane and acrylic enamel and basecoat reducers, lacquer thinners, etc.; cleaners, such as brake cleaners, adhesive removers, wax and grease removers, plastic part cleaners, and oils, asphalt and pharmaceutical products for all industries, etc.; as well as other applications.

In accordance with still another embodiment of the disclosure, the solvent can is preferably a 5 gallon can, but other sizes or capacity cans, such as 2.5 gallons, 3 gallons, 4 gallons, 10 gallons, 20 gallons, 20 liters, etc. are also contemplated.

In accordance with another embodiment of the disclosure, the solvent can be a cylinder, but other shapes, such as a square or rectangular box are also contemplated.

In accordance with another embodiment of the disclosure, a bung assembly can be positioned in a position from the bottom of the can, such that position can be about 14 inches from the bottom of the can to about 4 inches or more from the bottom of the can. A tap assembly is mounted to the bung assembly.

In accordance with another embodiment of the disclosure, a tap assembly is positioned centrally between handle connecting members.

In accordance with another embodiment of the disclosure, a cable or tie strap can be attached to the tap through a hole formed through a handle. The tie strap is used to attach the tap to the can during shipment. The tap is then threaded into the bung before use.

In accordance with another embodiment of the disclosure, a tap and solvent container assembly includes a container having an upper wall, a bottom wall and a side wall connecting the upper wall and the bottom wall; a bung hole formed in the side wall and a threaded bung assembly mounted in the bung wall. The threaded bung assembly has a threaded member and a tap assembly is threadedly mounted to the bung assembly threaded member.

In accordance with another embodiment of the disclosure, a method for dispensing liquid from a solvent container, includes: providing a solvent can with a bung assembly, including an opening, plug, and threaded member mounted thereto; removing the plug from the bung assembly; inserting a tap assembly into the bung threaded member; filling the solvent can with liquid such as solvent, paint thinners or reducers opening the tap assembly by having a handle on the tap assembly to an open position; and dispensing the liquid through a faucet on the tap assembly.

In accordance with still another embodiment of the disclosure, a gallon of liquid can be dispensed in approximately 30 seconds which minimizes spilling and saves money and is easier, faster and safer than the way liquids are currently being dispensed.

In accordance with another aspect of the disclosure, a tap and solvent container assembly has a crimped lid with a bung having a bung mixer attached thereto for mixing coatings inside the container.

Still other aspects of the disclosure will become apparent upon reading and understanding of the following detailed description.

DETAILED DESCRIPTION OF THE DISCLOSURE

Figure 1:
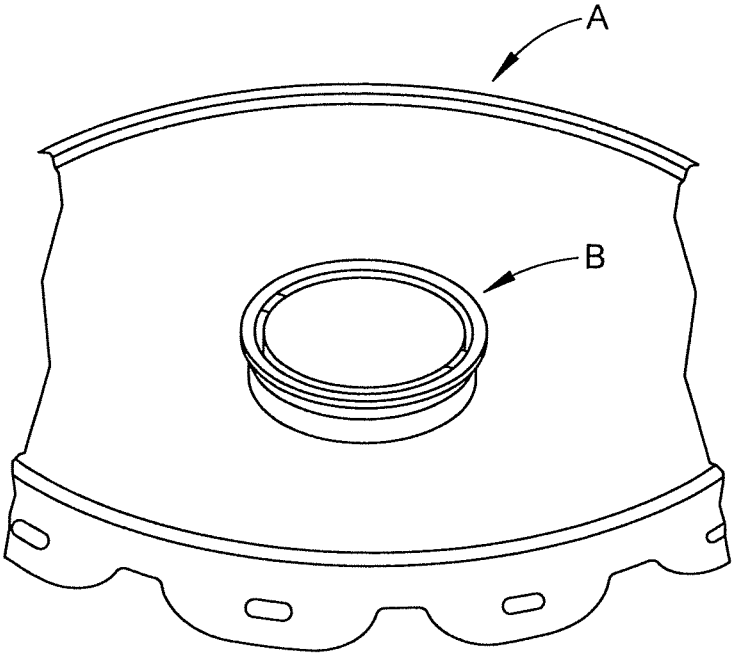
FIG. 1 (PRIOR ART)
FIG. 1 is a partial perspective view of a top wall of an existing solvent can with a bung cap installed thereon.
Figure 2:
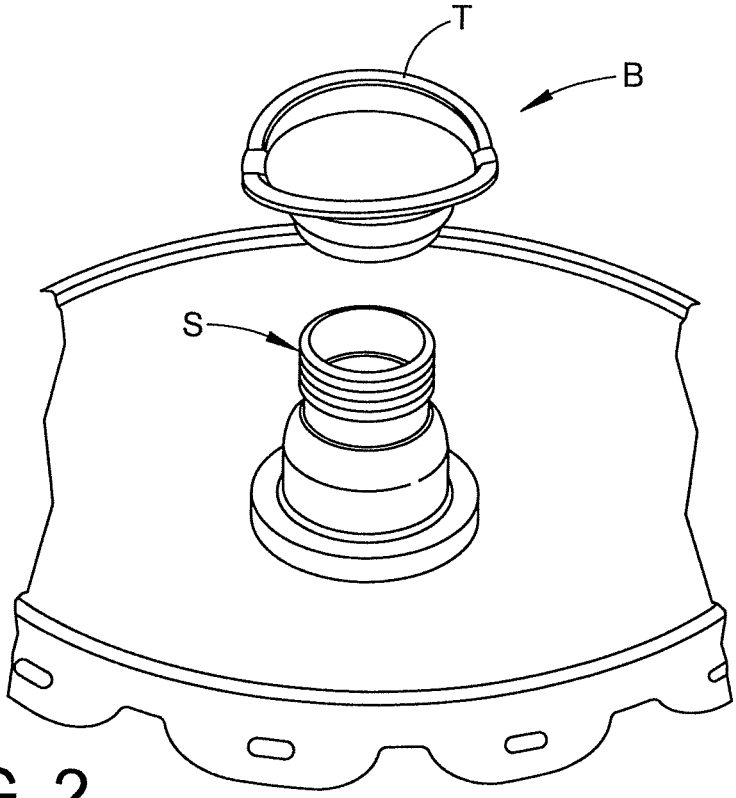
FIG. 2 (PRIOR ART)
FIG. 2 is a partial perspective view of the can of FIG. 1 with the bung cap removed and the spout extending from the top wall of the can.
Figure 2A:
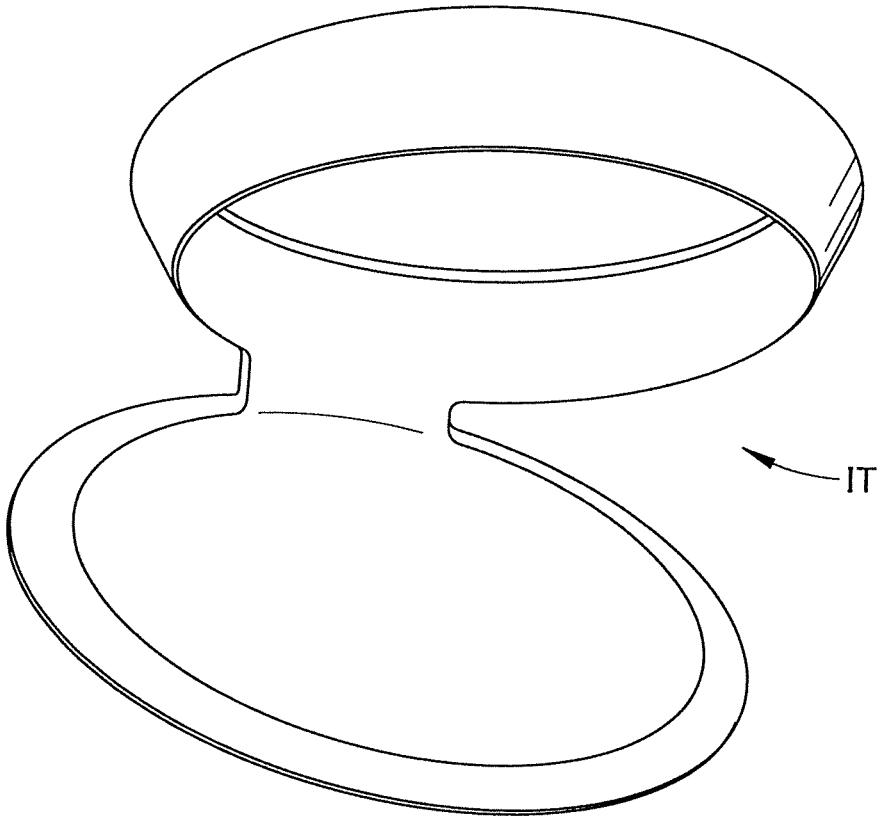
FIG. 2A (PRIOR ART)
FIG. 2A is a perspective view of an inner seal tab of the can of FIG. 2.
Figure 3:
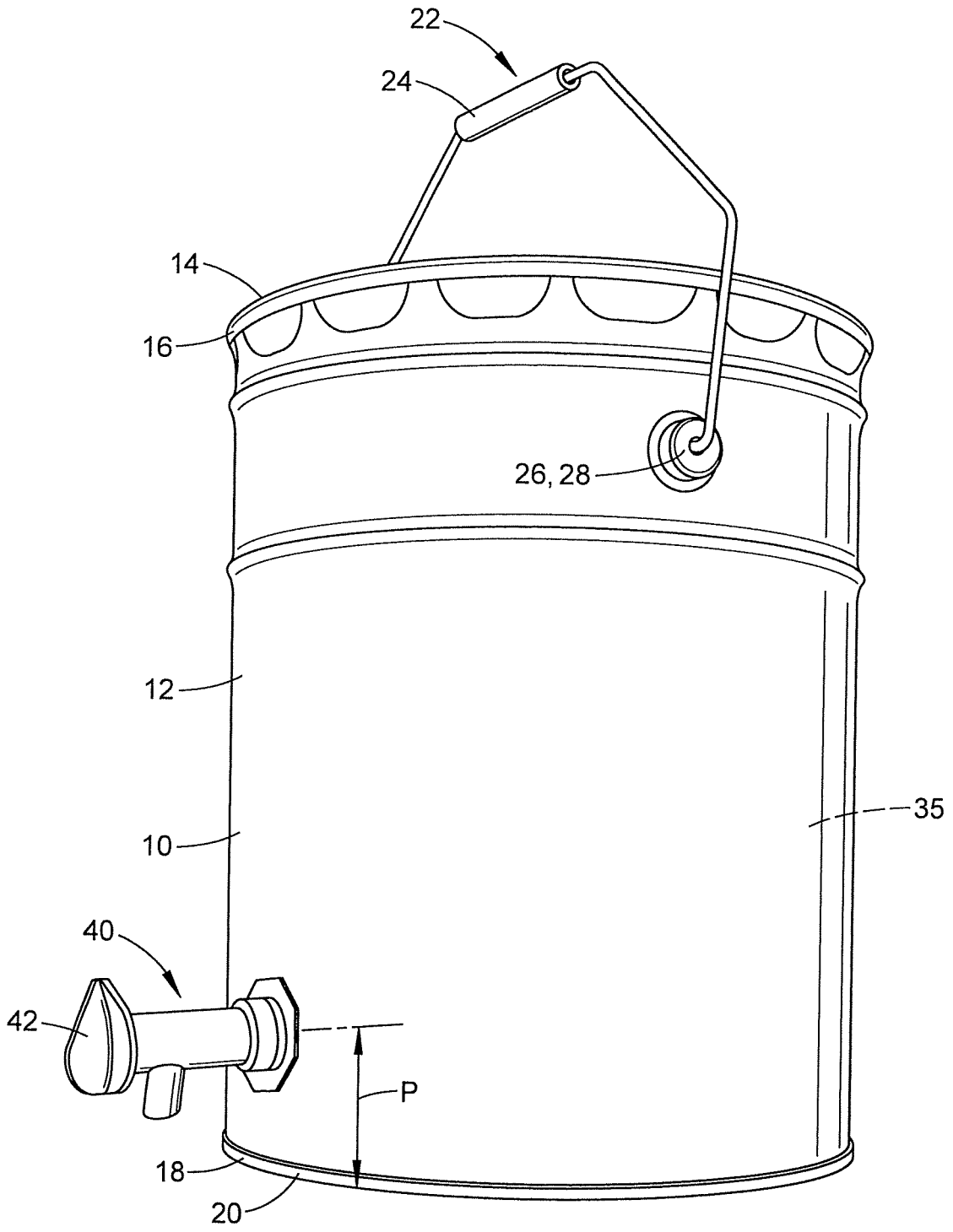
FIG. 3 is a perspective view of a solvent can with a tap mounted thereon in accordance with a preferred embodiment of the disclosure.

Referring now to FIGS. 3-6 in accordance with a preferred embodiment of the disclosure, a metallic solvent can or canister or container 10 has a continuous side wall 12 forming the body of the can. A top head or lid 14 is attached to an upper edge 16 of wall 12. An alternative would be a one piece can which has the lid manufactured securely on the top of the can and is not removable. A bottom wall 18 is secured to a bottom edge 20 of wall 12. A handle assembly 22 having a gripping portion 24 and a pair of connecting members 26, 28 on opposite sides of the body of the can.

A bung hole 30 is provided on wall 12 and is normally closed by a threaded bung assembly 32.

Although the illustrated embodiment is applied to a metal solvent can, the disclosure is equally applicable to other containers, such as plastic containers, etc. The solvent can itself is made of metal or steel, such as stainless steel, as well as the lid and bottom wall. However, the solvent can also be made of durable plastic, or possibly a combination of plastic and metal.

An internal chamber 35 is formed by the wall 12 to store the liquid such as solvents, paints, degreasers, cleaners, paint thinners or reducers, etc. The tap and can assembly of the disclosure can be used in at least the following applications: paint and coatings, such as clears, primers, rustproofing, truck bed coatings, etc.; solvents such as Xylene, Acetone, Toluene, mineral spirits, gun wash, etc.; reducers and thinners, such as urethane and acrylic enamel and basecoat reducers, lacquer thinners, etc.; cleaners, such as brake cleaners, adhesive removers, wax and grease removers, plastic part cleaners, and oils for all industries, etc.; as well as other applications.

The solvent can 10 is preferably a 5 gallon can, but other sizes or capacity cans, such as 2.5 gallons, 3 gallons, 4 gallons, 10 gallons, 20 gallons, 20 liters, etc. are also contemplated by the disclosure.

Also, the solvent can is shown as a cylinder, but other shapes, such as a square or rectangular box are also contemplated.

Figure 4:
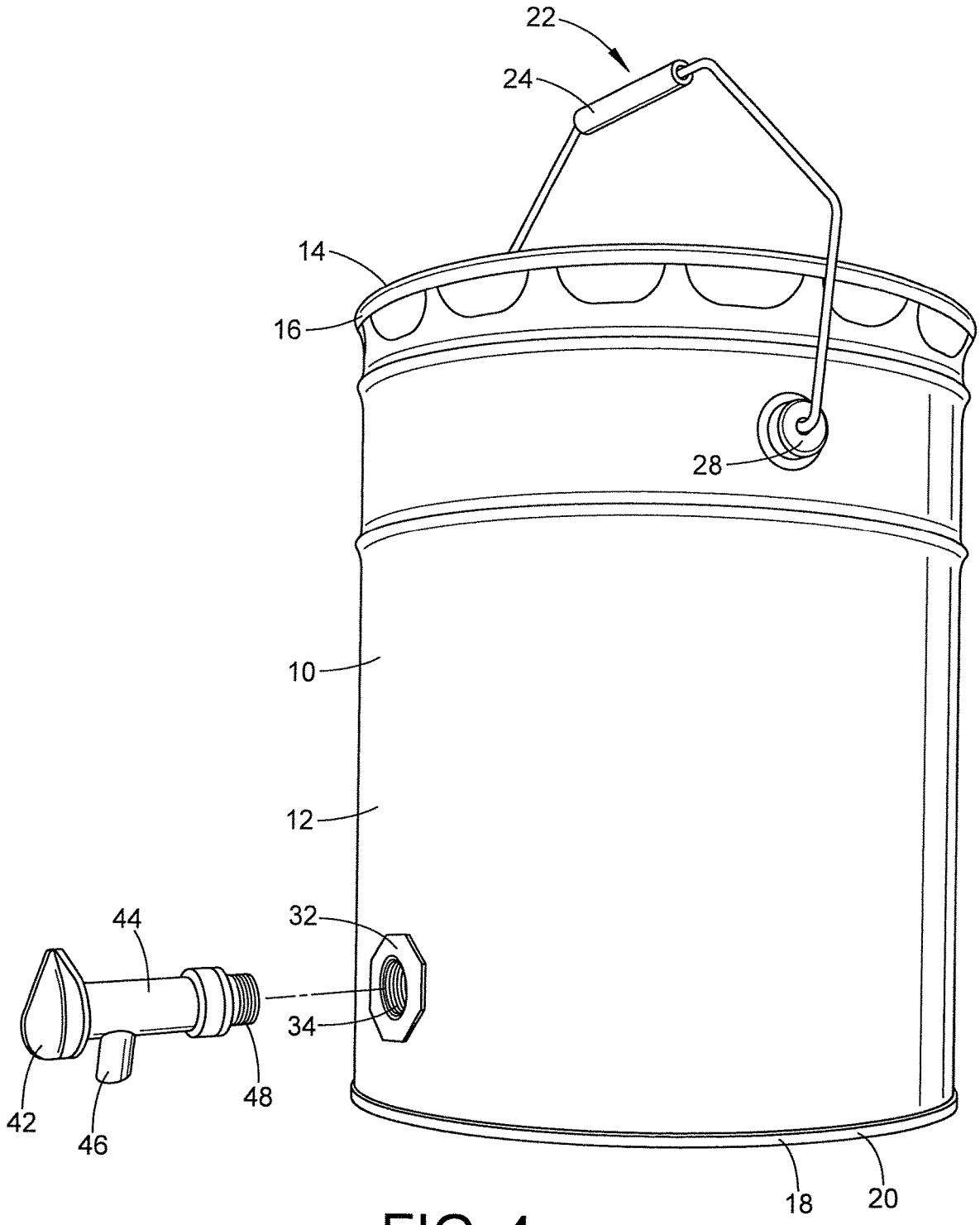
FIG. 4 is an exploded perspective view of the solvent can of FIG. 3 with the tap removed.
Figure 5:
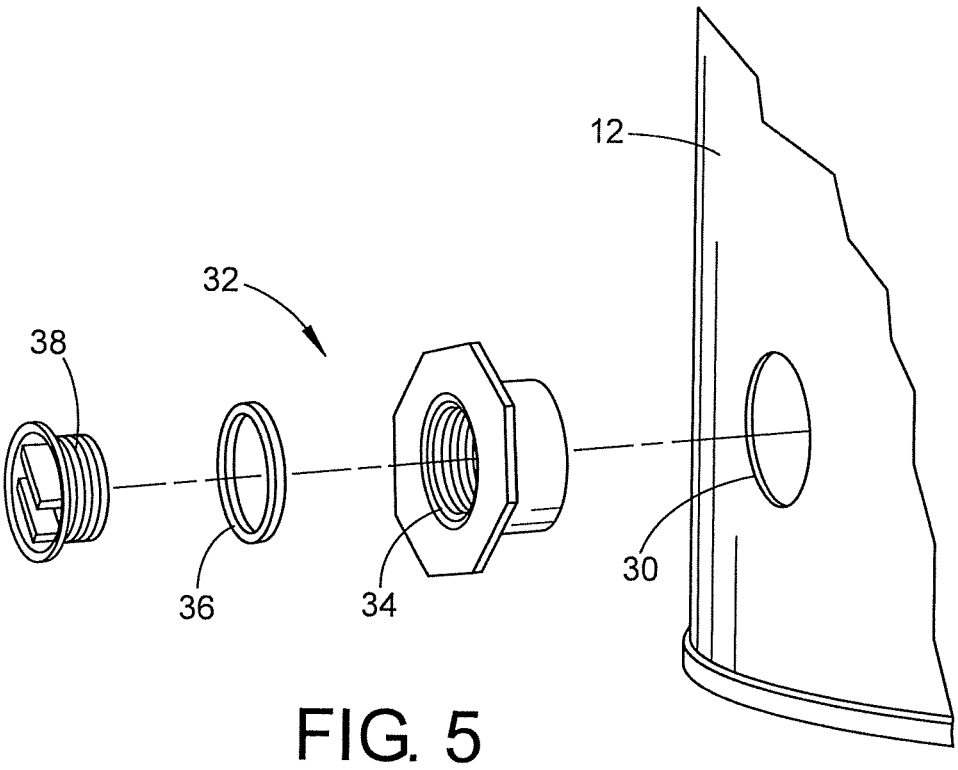
FIG. 5 is an exploded perspective view of the bung of the can of FIG. 3; and, FIG. 6 is a front perspective view showing the tap positioned centrally between the handle connections of the can in accordance with another embodiment of the disclosure.

Referring now to FIG. 4, the bung assembly 32 comprises a threaded portion 34 which is inserted into hole 30 of wall 12. Referring to FIG. 5, an o-ring 36 and a threaded plug 38 are also inserted into the threaded portion 34. As an example, the threads of the bung can be a ¼ inch pipe thread, but other thread sizes are also contemplated by the disclosure.

The bung assembly can be positioned in a position P from the bottom of the can, such that position P can be in the range of about 4 inches from the bottom of the can to about 14 inches or more from the bottom of the can.

Tap assembly 40 is shown as mounted or threaded to the bung assembly 32. The tap 40 can be a conventional tap and can be similar to those described in U.S. Pat. Nos. 4,321,240 and 4,640,493, which are incorporated by reference herein. The tap has a handle 42 which is rotated between open and closed portions, thus opening or closing a valve assembly such as a ball valve or check valve to dispense liquid or prevent dispensing liquid which is known in the art.

The tap has a body 44 which has a spigot (or faucet) 46 for dispensing the liquid or paint. Body 44 has a threaded end 48 which is threadedly coupled to bung threaded portion 34.

Referring to FIG. 4, a preferred embodiment shows the tap assembly 40 positioned centrally between handle connecting members 24, 26. Other configurations are also contemplated by the disclosure.

Figure 7:
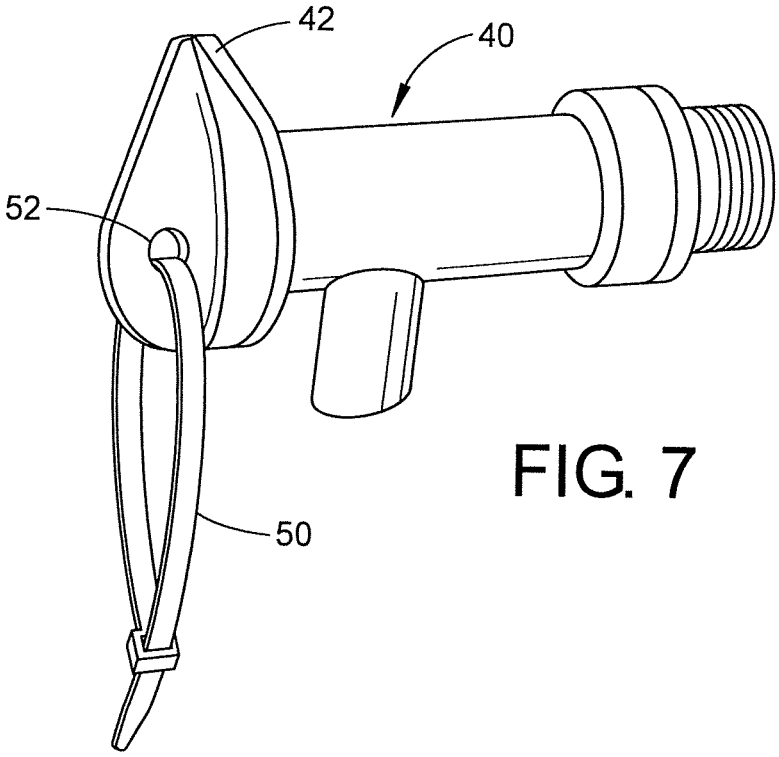
FIG. 7 is a perspective view of a tap with a cable strap extending therethrough in accordance with another embodiment of the disclosure; and, FIG. 8 is a perspective view with a cutaway view of a container having a bung with a bung mixer thereon in accordance with another embodiment of the disclosure.
Figure 6:
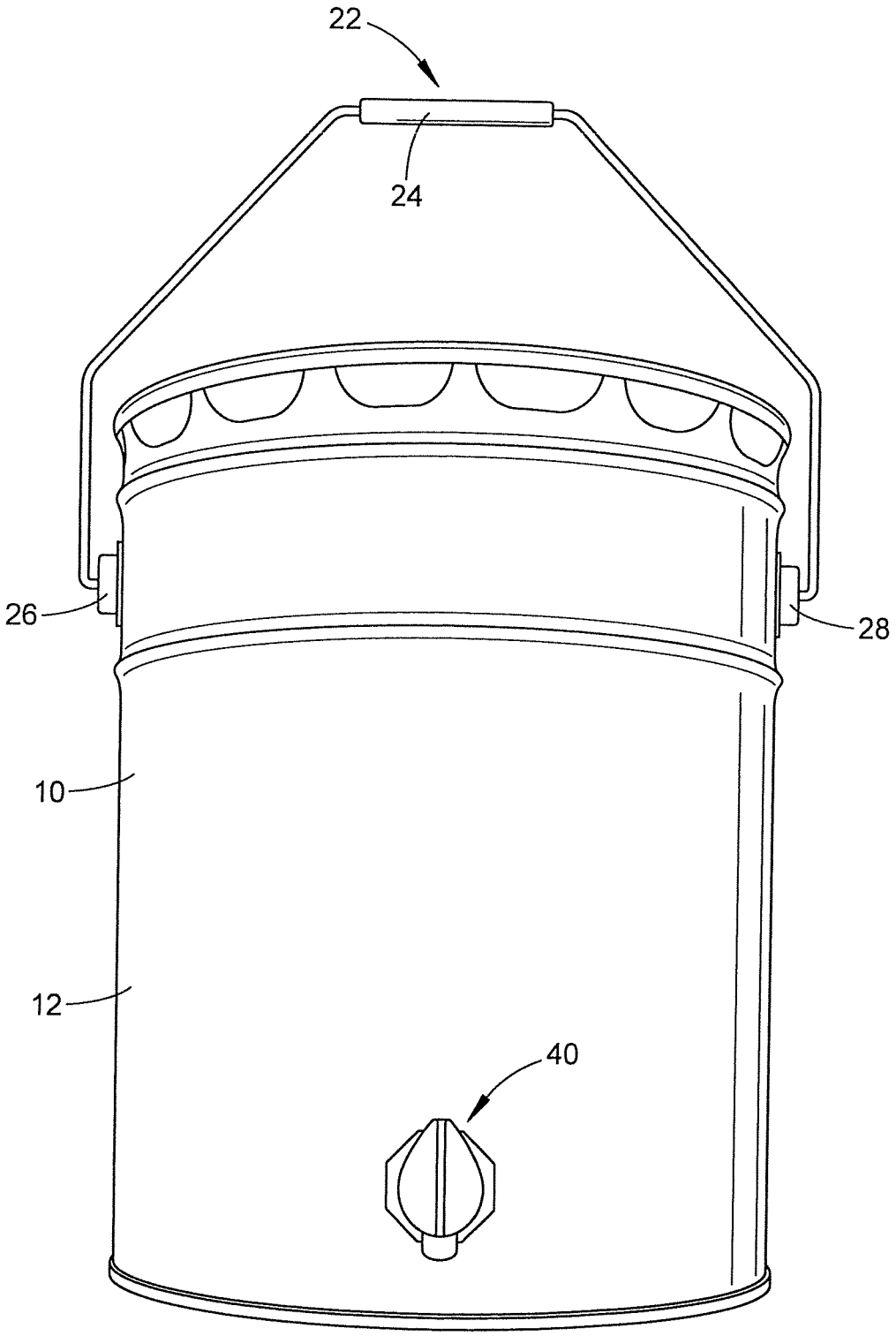

Referring now to FIG. 7, a cable or tie strap 50 can be attached to the tap 40 through a hole 52 formed through a handle 42. The tie strap 50 is used to attach the tap to the can during shipment. The tap is then threaded into bung 32 before use.

The present disclosure relates to a combination of a tap valve with a solvent can or container, such as a 5 gallon container, which is unique and is not found in existing systems or containers.

Figure 8:
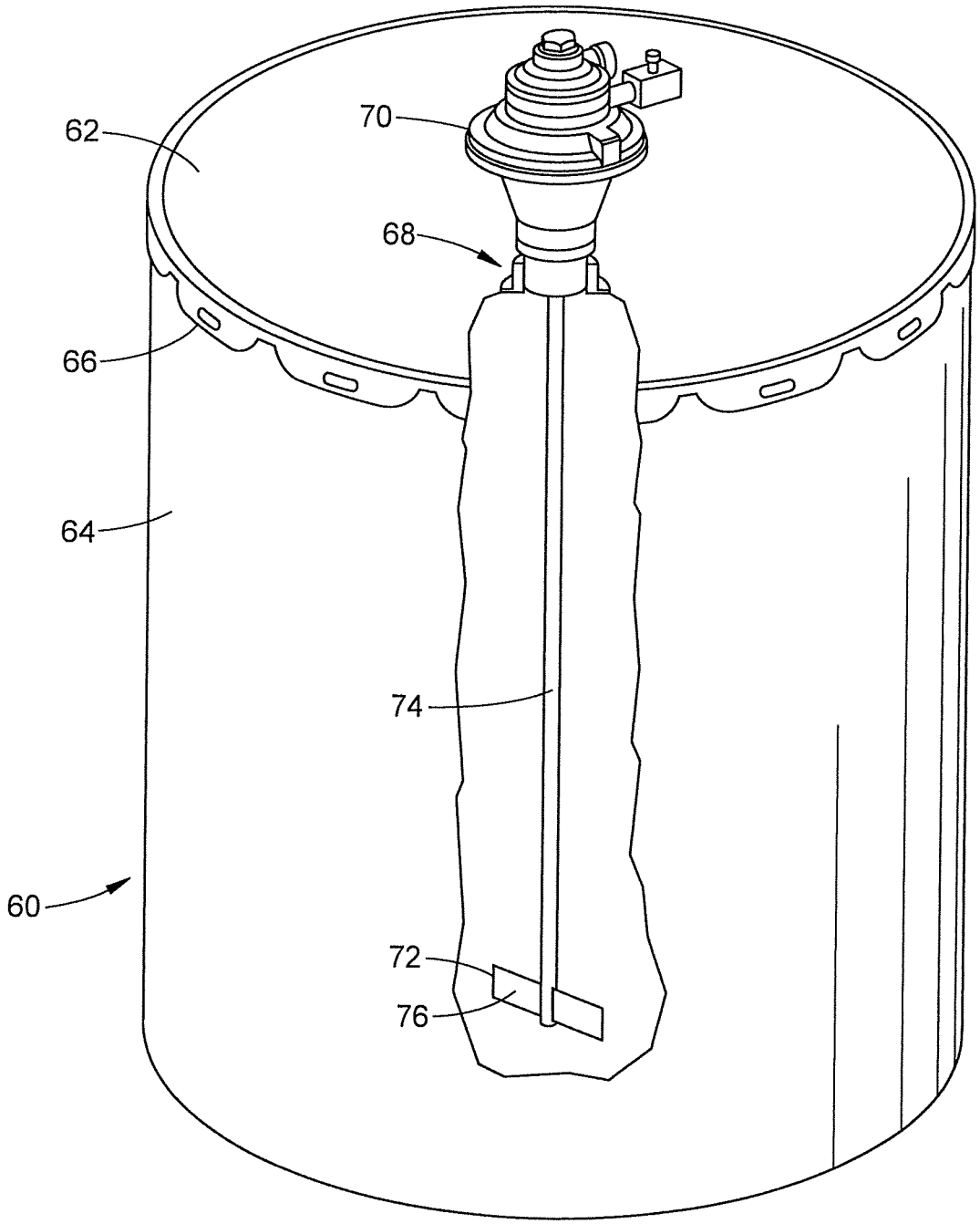

Referring now to FIG. 8, in accordance with yet another embodiment of the disclosure, a container 60 has a lid 62 crimped onto upper end of body 64, via crimping 66. Centrally positioned within the lid 62 is a bung 68 onto which a bung mixer 70 is placed. The mixer 70 shown is a conventionally available ¾ hp air direct drive bung mount mixer.

The mixer has folding props 72 which can slip through the bung opening and automatically open with centrifugal force. The mixer works both in both side and center placed bung openings. The mixer preferably has a ⅝ inch diameter shaft 74 and set screw attached impellers 76. A needle valve controller provides precise speed control on a no-tube air motor. The mixer is used to mix coatings, inside the tap pail. The bung will have threads so the mixer is can be screwed into the bung.

The present disclosure provides a novel way of dispensing solvents or paints, instead of unscrewing the bung cap on the lid, pulling the spout out and tipping the can pouring the contents out of the can or pumping. Using the tap, a gallon of liquid can be dispensed in approximately 30 seconds which minimizes spilling and saves money and is easier, faster and safer than the way liquids are currently being dispensed.

The exemplary embodiment has been described with reference to the preferred embodiments. Obviously, modifications and alterations will occur to others upon reading and understanding the preceding detailed description. It is intended that the appended claims be construed as including all such modifications and alterations insofar as they come within the scope of the embodiments or the equivalents thereof.

The invention claimed is:

1. A tap and solvent container assembly comprising:

a container comprising an upper wall, a bottom wall and a side wall connecting said upper wall and said bottom wall;

a first bung hole formed in said side wall and a first threaded bung assembly mounted in said first bung hole;

said first threaded bung assembly comprises a threaded member extending through said first bung hole to an interior volume of said container and comprises a set of internal threads configured to alternatively removably receive one of a threaded tap assembly and a threaded plug, such that the container is converted from a plugged state to a tapped state and vice versa;

said threaded tap assembly comprises a longitudinally extending tap body, a spigot configured to dispense a liquid therefrom, and a threaded tap end including a set of external tap threads wherein said set of external tap threads are configured to threadedly engage said set of internal threads of said threaded member in said tapped state;

said threaded plug comprises a set a set of external plug threads configured to threadedly engage said set of internal threads of said threaded member in said plugged state and providing a leak free seal of said first bung hole in said plugged state;

and a mixer threaded into threads of a second threaded bung assembly that extends into a lid of said container through a second bung hole to mix liquid within said container.

2. The tap and solvent container assembly of claim 1, further comprising a handle assembly connected to opposite sides of said side wall.

3. The tap and solvent container assembly of claim 1, wherein said container is a cylinder.

4. The tap and solvent container assembly of claim 1, wherein said container has an internal chamber for containing one of: solvents, paints, degreasers, cleaners, paint thinners and paint reducers.

5. The tap and solvent container assembly of claim 1, wherein said container is one of a 5 gallon can, a 10 gallon can, and a 25 gallon can.

6. The tap and solvent container assembly of claim 1, wherein said first threaded bung assembly is positioned in the range of 4 inches to 14 inches or more from said bottom wall of said container.

7. The tap and solvent assembly of claim 1, wherein said first threaded bung assembly further comprises an o-ring and a threaded plug which are inserted into said threaded member.

8. The tap and solvent container assembly of claim 1, wherein said threaded member has ¼ inch threads.

9. The tap and solvent container assembly of claim 1, wherein said tap assembly comprises a handle, a faucet, and a threaded end member.

10. The tap and solvent container assembly of claim 9, further comprising a tie strap attached to said tap assembly handle through an opening in said tap assembly handle.

11. The tap and solvent container assembly of claim 1, wherein said upper wall is crimped along an entire outer edge onto an upper edge of said side wall of said container.

12. A method for dispensing liquid from a container, comprising:

providing a solvent can with a first threaded bung assembly mounted to wall of said can, said first threaded bung assembly including an opening, a threaded plug, and a threaded member mounted thereto;

said threaded member extends through said opening to an interior volume of said solvent can and comprises a set of internal threads configured to alternatively removably receive one of a threaded tap assembly and a threaded plug, such that the solvent can is converted from a plugged state to a tapped state and vice versa;

removing said threaded plug from said first threaded bung assembly;

inserting a threaded tap assembly into internal threads of said threaded member, said threaded tap assembly comprising a longitudinally extending tap body, a spigot configured to dispense a liquid therefrom, and a threaded tap end including a set of external tap threads wherein said set of external tap threads are configured to threadedly engage said set of internal threads of said threaded member;

filling said solvent can with one of solvent, paint thinners and reducers;

opening said threaded tap assembly by rotating a handle on said tap assembly to an open position;

dispensing said liquid through a faucet on said tap assembly; and providing a mixer threaded into threads of a second threaded bung assembly that extends into a lid of said solvent can through a second bung hole within the solvent can.

13. The method of claim 12, wherein:

a handle assembly is connected to opposite sides of the solvent can.

14. The method of claim 12, wherein the solvent can is a cylinder.

15. The method of claim 12, wherein said solvent can has an internal chamber for containing one of: solvents, paints, degreasers, cleaners, paint thinners and paint reducers.

16. The method of claim 12, wherein said solvent can is one of a 5 gallon can, a 10 gallon can, and a 25 gallon can.

17. The method of claim 12, wherein said first threaded bung assembly is positioned in the range of 4 inches to 14 inches or more from a bottom wall of said solvent can.

18. The method of claim 12, wherein said bung threaded member has ¼ inch threads.

19. The method of claim 12, wherein a tie strap is attached to said tap assembly handle through an opening in said tap assembly handle.

* * * * *